US005291246A

United States Patent [19]

Tsukamoto

[11] Patent Number: 5,291,246

[45] Date of Patent: Mar. 1, 1994

[54] ELECTROPHOTOGRAPHIC PRINTING MACHINE

[75] Inventor: Kimihide Tsukamoto, Yamatokoriyama, Japan

[73] Assignee: Sharp Kabushiki Kaisha, Osaka, Japan

[21] Appl. No.: 911,918

[22] Filed: Jul. 10, 1992

[30] Foreign Application Priority Data

Jul. 15, 1991 [JP] Japan ..... 3-174094

[51] Int. Cl.[5] ..... G03G 15/00; G03G 13/00

[52] U.S. Cl. ..... 355/210; 346/160.1; 355/200; 355/211; 355/27; 355/277; 355/282; 355/285; 355/290

[58] Field of Search ..... 355/210-213, 355/200, 282, 285, 290, 295, 271, 277, 272-275, 257, 258; 346/153.1, 160, 160.1

[56] References Cited

U.S. PATENT DOCUMENTS

| | | | |
|---|---|---|---|
| 2,843,084 | 7/1958 | Hayford | 355/263 X |
| 3,654,654 | 4/1972 | Abreu et al. . | |
| 3,697,409 | 10/1972 | Weigl . | |
| 3,722,992 | 3/1973 | Zweig | 355/210 |
| 3,844,779 | 10/1974 | Weigl . | |
| 3,924,945 | 12/1975 | Weigl | 355/258 |
| 3,937,572 | 2/1976 | Gaynor et al. | 355/217 |
| 4,021,106 | 5/1977 | Gaynor | 355/200 |
| 4,027,964 | 6/1977 | Fantuzzo et al. . | |
| 4,458,258 | 7/1984 | Amaya et al. | 346/153.1 |
| 4,547,787 | 10/1985 | Kaneko et al. | 346/160 |
| 4,851,926 | 7/1989 | Ishikawa | 346/160 X |
| 4,931,876 | 6/1990 | Hashizune | 346/160 X |
| 5,057,875 | 10/1991 | Itoh | 355/277 X |
| 5,065,187 | 11/1991 | Itoh et al. | 355/215 |
| 5,115,278 | 5/1992 | Maruta et al. | 355/285 |
| 5,138,387 | 8/1992 | Sato et al. | 355/251 |
| 5,148,225 | 9/1992 | Takeda et al. | 355/272 |

FOREIGN PATENT DOCUMENTS

| | | |
|---|---|---|
| 0380130A3 | 8/1990 | European Pat. Off. . |
| 0424085A3 | 4/1991 | European Pat. Off. . |
| 2-4900 | 1/1980 | Japan . |
| 59-37578 | 3/1984 | Japan . |

OTHER PUBLICATIONS

*Journal of Applied Physics*, vol. 63, No. 11, American Institute of Physics, Jun. 1, 1988, pp. 5589-5593 (Tetsutani and Hoshino authors).

Nikkei Electronics, Apr. 18, 1988.

*Primary Examiner*—A. T. Grimley

*Assistant Examiner*—Matthew S. Smith

*Attorney, Agent, or Firm*—David G. Conlin; George W. Neuner

[57] ABSTRACT

An electrophotographic printing machine is provided with a photoreceptor drum including a cylindrical transparent support having a transparent electrically conductive layer and a photoconductive layer laminated on a surface thereof and a dielectric belt having wound around the photoreceptor drum. A toner image is formed on a surface of a dielectric belt through a process of exposing the photoconductive layer by applying voltage across the toner to be applied to the surface of the dielectric belt and the transparent electrically conductive layer. Then, the toner image is transported up to a position apart from the photoreceptor drum where a copying material is superposed onto the toner image so as to apply heat and pressure thereto, whereby transfer and fusing processes of the toner image are carried out simultaneously to the copying material. As a result, a turbulence in the toner image is reduced, thereby providing high quality images.

33 Claims, 4 Drawing Sheets

ELECTROPHOTOGRAPHIC PRINTING MACHINE

FIELD OF THE INVENTION

The present invention relates to an electrophotographic printing machine which forms images through a method wherein a toner image is formed by developing an electrostatic latent image formed on a surface of a photoreceptor using a photoconductive phenomenon, thereafter, transferred to a copying material and made permanent on the copying material.

BACKGROUND OF THE INVENTION

Conventionally, in forming images using toner particles, an electrophotography has been generally used, i.e., an application of the Carlson process. The principle of the electrophotography is described in detail in reference to FIG. 6 through an example of a normal developing system adopted in photocopying machines. In the photocopying machine which employs the Carlson process, a charger 32, an exposure unit 33, a developer unit 34, a transfer unit 35, a fuser 36, a cleaner 37, and an eraser 38 are provided in this order along the circumference of a photoreceptor drum 31 having a photosensitive layer formed on the surface thereof as shown in FIG. 6.

With this arrangement, first, the surface of the photoreceptor drum 31 is uniformly charged by the charger 32 in a dark place. Next, an original image is illuminated on the surface of the photoreceptor drum 31 by the exposure unit 33 so as to remove charges from the illuminated portion, thereby forming an electrostatic latent image on the surface of the photoreceptor drum 31. Thereafter, a toner 39 is made to adhere the electrostatic latent image, the toner 39 being charged by applying thereon a charge having a polarity opposite to the charge on the photoreceptor drum 31 in the developer unit 34, thereby forming a visible image of the toner 39. Further, a copying material 40 is superposed on the visible image. Then, a corona-discharging is carried out by the transfer unit 35 from the back surface of the copying material 40 so as to apply a charge having a polarity opposite to the toner 39. As a result, the toner image is transferred to the copying material 40. Then, using heat and pressure of the fuser 36, the transferred toner image is made permanent on the copying material 40. On the other hand, a residual toner 39*a* remaining on the photoreceptor drum 31 after the transfer is removed by a cleaner 37. After the discharging operation is carried out from the electrostatic latent image on the photoreceptor drum 31 by projecting thereon a light beam from the eraser 38, the process starting with the charging operation by the charger 32 is repeated, thereby successively forming images.

In the discussed electrophotography, i.e., the application of the Carlson process, normally a corona discharger is adopted for charging the photoreceptor drum 31 or transferring the toner 39 to the copying material 40. However, when the corona discharger is adopted, a high voltage of several kV is required. Moreover, it is likely to be affected by a change in the ambient condition, for example, a change in the charge amount on the surface of the photoreceptor drum 31 due to a temperature change. Furthermore, ozone produced in the process of corona charging results in the problem in terms of an environmental health.

In order to counteract the above-mentioned problem, an image forming method not requiring the corona charging is disclosed in Japanese Laid-Open Publication 4900/1990 (Tokukouhei 2-4900). When adopting the method, as shown in FIG. 7, a photoreceptor 50 is desirably arranged such that a transparent electrically conductive layer 52 made of $In_2O_2$, etc., a photoconductive layer 53 made of Se etc., and a dielectric layer 54 made of polyethlene terephtalate film, are laminated in this order on a transparent base 51 made of glass or the like. When a magnet 56 as a toner holder having an electrically conductive and magnetic toner 55 adhering thereto is brought close to the surface of the photoconductor 50, in the mean time, the surface of the photoconductor 50 is exposed from the side of a transparent base 51 while applying voltage between the magnet 56 and the transparent electrically conductive layer 52, a resistance of the photoconductive layer 53 at the illuminated portion drops, whereby a charge is injected under the dielectric layer 54. Then, a strong electric field is applied between the magnet 56 and the photoconductor 50, thereby being injected a charge having polarity opposite to that of the toner 55 corresponding to the exposure area. As a result, the charged toner 55 and the charge injected through the transparent electrically conductive layer 52 become being attracted from one another having the dielectric layer 54 in between by making pairs with charges having opposite polarities. In this way, even when the magnet 56 is moved away from the photoconductor 50, the toner 55 at the exposed portion remains on the surface of the photoconductor 50.

As described, the discussed method enables a toner image to be formed on the surface of the photoconductor 50 without using the corona charging. After the toner image is formed on the surface of the photoconductor 50, the toner image is transferred from the surface of the photoconductor 50 to the surface of the copying material as in the case of the Carlson process. Thereafter, the toner is transported to the fuser which heats up the toner to be melted, thereby the toner image is permanently affixed to the copying material.

However, the photoconductor 50 arranged such that the surface of the transparent base 51 whereon the transparent electrically conductive layer 52, the photoconductive layer 53, and the insulating layer 54 are laminated in this order, may be damaged by repeating the image forming process, especially by the repetitive sliding contact of the toner 55 with the insulating layer 54 provided on the periphery surface, or by the blade-shaped cleaner for removing the residual toner on the surface of the insulating layer 54 after the transfer. Especially, when coating the photosensitive layer 53 with an insulating resin material so as to make the dielectric layer 54, an adhesive characteristic to the surface of the photosensitive layer 53, or solubility with respect to solvent needs to be considered in selecting the material. For this reason, the material to be used in the insulating layer 54 is restricted such as polyethlene terephtalate, and the material excellent in its hard-wearing properties, may not be selected. This presents the problem of a high deterioration rate of the dielectric layer 54 which shortens the life of the photoconductor 50.

SUMMARY OF THE INVENTION

An object of the present invention is to provide an electrophotographic printing machine capable of providing longer life of constituting components such as a photoreceptor drum which enables an image to be formed without using corona-charging.

Another object of the present invention is to trim a size of an electrophotographic printing machine or to provide an electrophotographic printing machine capable of improving an image quality.

In order to achieve the above objects, an electrophotographic printing machine in accordance with the present invention is characterized in comprising: photoreceptor means including a cylindrical base having an electrically conductive layer and a photoconductive layer laminated in this order on a periphery surface thereof; dielectric moving means wound around a surface of the photoreceptor means and firmly adhering thereto for integrally moving therewith; electrically conductive toner support means for applying an electrically conductive toner on the surface of the moving means, the support means being provided in a vicinity of the surface of the moving means in a contact area between the moving means and the photoreceptor means; voltage application means for applying voltage across the toner support means and the electrically conductive layer; and exposure means for exposing the photoconductive layer in the contact area, wherein the exposure means exposes the photoconductive layer in the contact area while applying voltage across the toner support means and the electrically conductive layer, thereby forming a toner image on the surface of the moving means.

With this arrangement, the electrically conductive layer and photoconductive layer are sequentially formed on the periphery surface of the cylindrical base, and the dielectric moving means is in tight contact with the photoconductive layer. Further, the electrically conductive toner being supported by the toner support means adheres to the surface of the moving means. In this state, voltage is applied between the toner support means and the electrically conductive layer of photoreceptor means, whereby charges having opposite polarity from one another are laminated respectively on the electrically conductive toner and the electrically conductive layer with the photoconductive layer and the dielectric moving means interposed therebetween. Further, the photoconductive layer is exposed by the exposure means, thereby lowering the resistance of the exposed portion of the photoconductive layer. As a result, the charge having an opposite polarity to the charge laminated on the leading edge of the electrically conductive toner is injected to the moving means side of the photoconductive layer, thereby forming an electrostatic latent image. In this case, the electrically conductive toner corresponding to the electrostatic latent image is affected by strong Coulomb force that occurred between them. Therefore, the Coulomb force between the electrostatic latent image and the toner is set greater than the holding power for holding the toner on the toner support means, for example, by controlling voltage to be applied between the toner support means and the electrically conductive layer, or the holding power for holding the toner on the toner support means. In this way, when the toner support means is moved away from the moving means, the toner image corresponding to the electrostatic latent image is formed on the surface of the moving means.

As described, since the toner image is formed on the moving means which is separately provided from the photoreceptor means, the surface of the photoreceptor means can be prevented from being damaged by the toner adhering thereto or cleaner in contact therewith in removing the toner. On the other hand, the moving means having the toner image formed on the surface thereof, is also provided separately from the photoreceptor means. Therefore, the material to be used for the moving means is not necessarily restricted by solubility with respect to solvent used in coating the photoconductive layer on the surface of the photoreceptor, or the like. The material excellent in its strength, hard-wearing properties, can be used as long as those can be formed with an adequate resistivity and thickness. By using the stronger material for the moving means, the deterioration rate of the moving means as well as the photoreceptor means can be reduced, thereby providing a longer life of the whole apparatus. Moreover, it is possible to replace only the moving means with new moving means without replacing the photoreceptor means. This also contributes to provide a longer life of the apparatus.

The electrophotographic printing machine having the described configuration may be arranged to further comprise: heating means for melting by a heat treatment the toner of the toner image formed on the surface of the moving means after the photoreceptor means passes a exposure area; and pressure means for pressing a superposed portion between the copying material and the moving means toward the heating means, the pressure means being disposed confronting the heating means so as to have the moving means and the copying material being transported thereon interposed in between.

With this arrangement, the heating means and the pressure means are provided so as to face one another having the moving means interposed in between. In other words, the moving means is provided separately from the photoreceptor means, therefore, the toner image formed on the surface of the moving means can be transferred up to a position apart from the photoreceptor means. In this position, the heating means and the pressure means can be disposed so as to face one another having the moving means interposed in between.

Moreover, since the moving means is separately provided from the photoreceptor means, the material excellent in its heat resistance can be selected for the moving means considering the fusing temperature of the toner. In this way, by pressing the copying material onto the toner being melted by a heat treatment on the surface of the moving means, the toner image can be transferred from the moving means to the copying material, and the toner image is made permanent on the copying material.

As described, unlike the case of conventional Carlson process, the discussed method does not require the transfer unit composed of the corona discharger, etc. This permits to trim the size of the apparatus. Moreover, with this method, the transferring and fusing processes are carried out simultaneously. Therefore, the turbulence of the toner image is reduced, the better quality of the toner image is attained compared with the conventional case where after being transferred to the copying material, the toner image is further transported to the fuser to be permanently affixed to the copying material.

Further, the electrophotographic printing machine in accordance with the present invention may also be arranged such that the cylindrical base and the electrically conductive layer of the photoreceptor means are made of a transparent material, and the exposure means is disposed in the photoreceptor means wherein a light beam is projected onto the photoconductive layer through the cylindrical base and the electrically conductive layer, thereby exposing the photoconductive layer.

With this arrangement, by providing the exposure means within the photoreceptor means, a space for providing the exposure means is not separately required. This permits to trim the size of the whole apparatus. Moreover, since the exposure means is covered by the photoreceptor means, dust adhering to the exposure means can be reduced. In this way, a constant amount of light beams projected from the exposure means can be maintained for a long time, whereby a desirable image quality can be maintained.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a typical depiction showing a schematic configuration of an electrophotographic printing machine.

FIG. 2 is an enlarged cross-sectional view explaining a principle in forming image with the machine of FIG. 1.

FIG. 3 is an enlarged cross-sectional view showing a change when an exposing operation is carried out with the state shown in FIG. 2.

FIG. 4 is an enlarged cross-sectional view showing a change from the state of FIG. 3 when the exposing operation is stopped.

FIG. 5 is an enlarged cross-sectional view showing a change from the state of FIG. 4 when a developer unit is separated from the surface of the photoreceptor drum.

FIG. 6 is a typical depiction showing a configuration of an image forming apparatus adopting a conventional Carlson process.

FIG. 7 is a typical depiction of a cross-sectional view explaining a toner image forming system without uniformly charging an entire surface of the photoconductive layer.

DETAILED DESCRIPTION OF THE EMBODIMENTS

Figure 5:
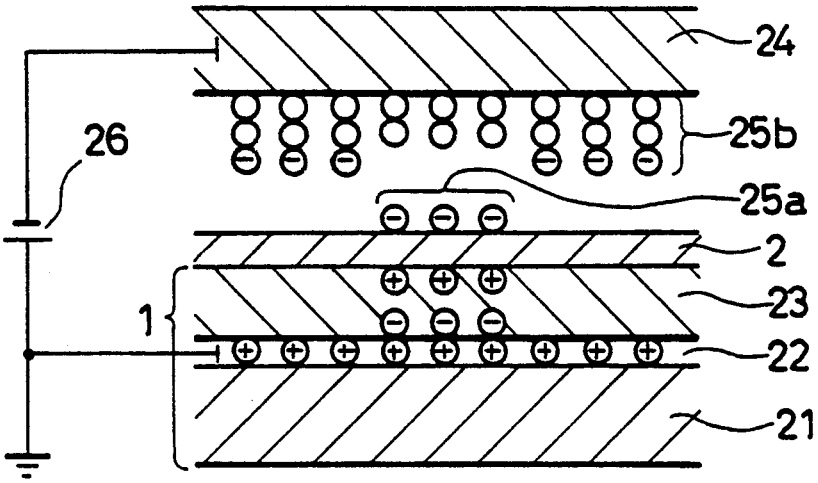
Figure 6:
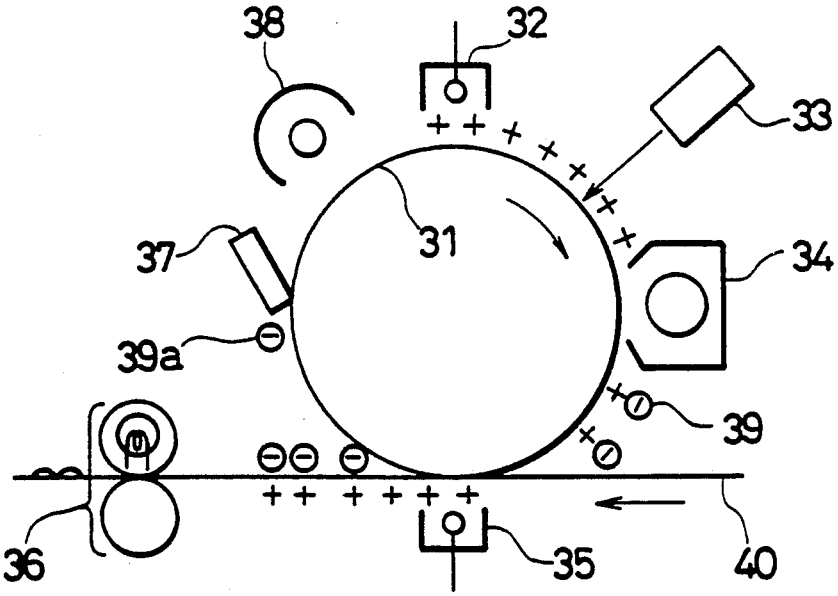
FIGS. 6 and 7 show the prior art.
Figure 7:
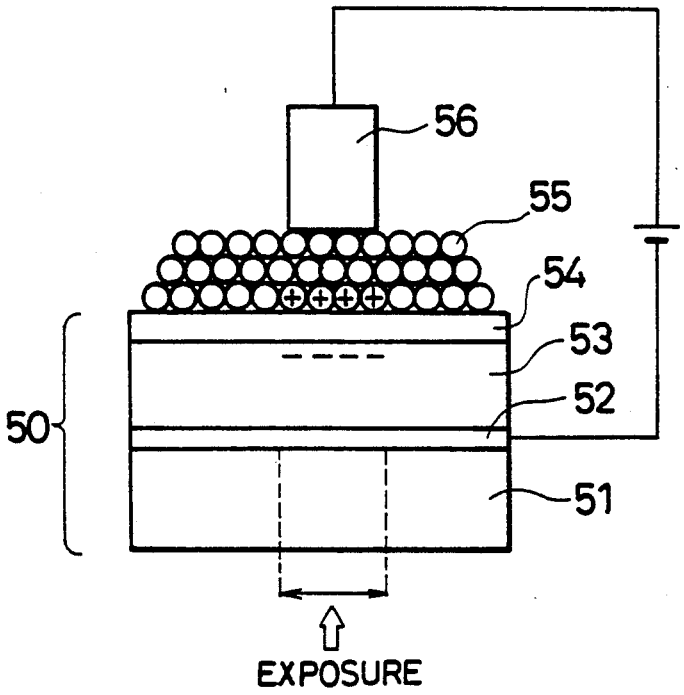

A first embodiment illustrating the present invention will be discussed hereinbelow with reference to FIGS. 1 and 5.

Figure 1:
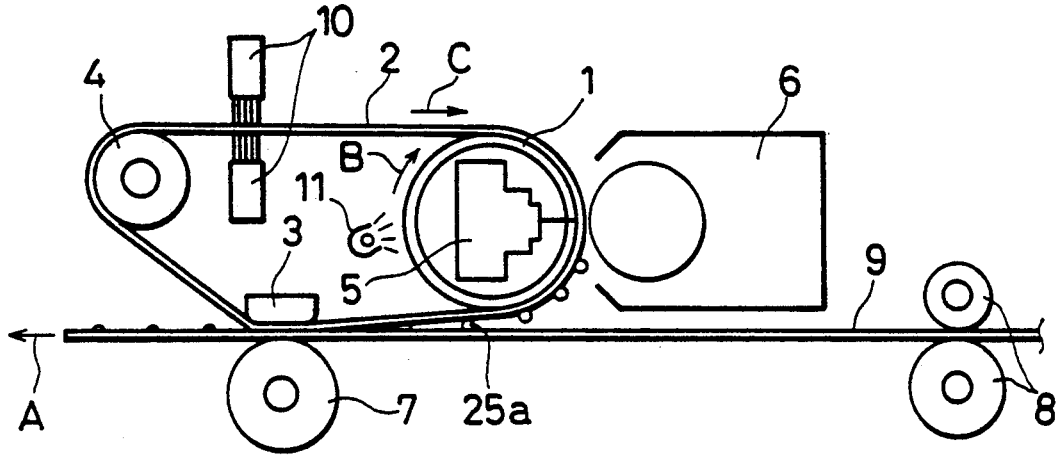
FIGS. 1 through 5 show one embodiment of the present invention.
Figure 2:
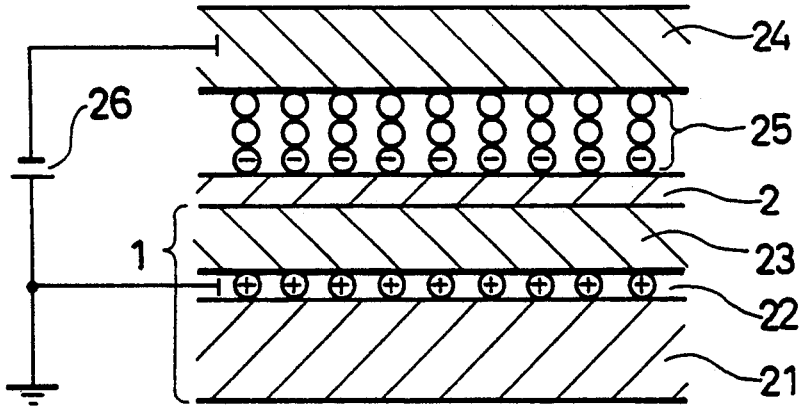

As shown in FIG. 1, an electrophotographic printing machine in accordance with the present embodiment comprises a cylindrical photoreceptor drum 1 (photoreceptor means) and a dielectric belt 2 (moving means) having wound around thereto. As shown in FIG. 2, the photoreceptor drum 1 is arranged as follows. A transparent electrically conductive layer 22 constituted of a thin film made of SnO: and a photoconductive layer 23 are formed in this order on a surface of a transparent support 21 (cylindrical base) made of glass. The photoconductive layer 23 is made of amorphous silicone (a-Si) with a thickness of substantially 20 μm.

As can be seen from the following Table 1, the dielectric belt 2 is made of film material including mainly a polyimide which is superior in its mechanical strength and heat resistance. The belt 2 is belt-shaped with no end with a thickness of substantially 20 μm.

[TABLE 1]

representative characteristics of polyimide film

| characteristics | measured value | measuring method |
|---|---|---|
| tensile force | 35.8 kg/mm$^2$ | ASTM D 882 |
| extension | 24% | ASTM D 882 |
| percentage extension | 660 kg/mm$^2$ | ASTM D 882 |
| elastic modulus (extended by 1%) | | |
| coefficient of friction | 0.3 | for steel ball |
| creep | | |
| 25° C. | 0.07% | 2.4 kg/mm$^2$ |
| 70° C. | 0.32% | 24 hours |
| specific gravity | 1.44 | — |
| heat decomposition temperature (5% loss in weight) | 635° C. | TGM 5° C./min |
| coefficient of linear expansion (25-180° C.) | $1 \times 10^{-5}$/°C. | TMA 5° C./min |
| surface resistivity | $10^{15}$ Ω | ASTM D 257 |

As shown in FIG. 1, the dielectric belt 2 belts the photoreceptor drum 1, a heater 3 (to be described later), and a tension roller 4 so as to surround them from outside. The dielectric belt 2 also receives appropriate strength of tensile force from the tension roller so as to be in tight contact with substantially a right hand side semi-circumference of the photoreceptor drum 1. The heater 3 is located on the left hand and slightly lower side of the photoreceptor drum 1. The tension roller 4 is placed on the upper left side of the heater 3.

On the other hand, an exposure means 5 is placed inside the photoreceptor drum 1. Further, the developer unit 6 storing toner (to be described later), is provided confronting the exposure unit 5 with a contact area between the dielectric belt 2 and the photoreceptor drum 1 interposed in between. The exposure unit 5 is arranged so as to include a light emitting diode (LED) array wherein a lens having a short focal distance is combined into the LED. Further, the exposure unit 5 projects a light beam in response to an exposure pattern signal from an exposure controlling unit (not shown) towards a developer unit 6 so as to be converged onto the photoconductive layer 23 through the transparent support 21 of the photoreceptor drum 1.

The heater 3 is disposed within a lower-side travel area between the exposure unit 5 and the tension roller 4 and in contact with an inner surface of the dielectric belt 2. The heater 3 is provided for heating up the toner to be melted, the toner adhering to the surface of the dielectric belt 2. The heater 3 is arranged to be a ceramic heater having a Mo series resistance heater and a glass coat laminated thereon in this order by printing. Further, the heater 3 is arranged such that a temperature of a heating surface thereof is rapidly raised up to a predetermined heating temperature by applying electric power to the resistance heater. The heating surface is in direct contact with the inner surface of dielectric belt 2.

Further, a pressurizing roller 7 (pressure means) rotating while applying pressing force towards the heater 3 is disposed under the heater 3. A sheet-like copying material 9 is fed by a pair of transport rollers 8 between the heater 3 and the pressurizing roller 7. The copying material 9 is transported in the transporting direction while being welded with pressure to the bottom side of the dielectric belt 2 by the pressurizing roller 7. Here, normally paper sheet (copying material) is used for the copying material 9; however, it is not necessarily limited to this type of copying material.

On the other hand, along the upper travel area of the dielectric belt 2 between the exposure unit 5 and the tension roller 4, a pair of erasers 10 is disposed having the dielectric belt 2 in between. Each of the erasers 10 connected to ground has a brush section at a leading edge thereof made of carbon conjugate fiber. The leading edges of the brush sections are respectively in sliding contact with inner and outer surfaces of the dielectric belt 2 while the dielectric belt 2 being traveled, thereby removing the charge adhering thereto.

The following description will discuss the operation of the electrophotographic printing machine having the above configuration.

When the copying material 9 is fed by the transport rollers 8 in the direction of arrow A, at the same time, the photoreceptor drum 1 is driven so as to rotate in a clockwise direction, i.e., in the direction of arrow B in the figure at the circumferential speed same as the transporting speed of the copying material 9. Further, the dielectric belt 2 wound around the photoreceptor drum 1 travels in the direction of arrow C at the same speed as the circumferential speed of the photoreceptor drum 1.

With the described operating state, the process for exposure for forming images is executed as follows. LED corresponding to a predetermined image pattern is selected in order, and a light beam is projected from the exposure unit 5 onto the photoconductive layer 23 of the photoreceptor drum 1, whereon an electrostatic latent image is formed. In the means time, the process for development is executed so as to visualize the electrostatic latent image with toner. The detailed description will be given hereinbelow referring to FIGS. 2 through 5.

In the developer unit 6, a developer electrode 24 (toner hold means) shown in FIG. 2 is provided. The developer electrode 24 is disposed in a vicinity of the surface of the dielectric belt 2 integrally moving with the surface of the photoreceptor drum 1 by being in direct contact therewith. Further, the developer electrode 24 is connected to magnetic field generation means (not shown) in the developer unit 6. Here, a permanent magnet or electro-magnet is preferably used for the magnetic field generation means. An electrically conductive magnetic toner 25 is made to adhere to the surface of the developer electrode 24 by magnetic field generated by the magnetic field generation means, thereby forming a magnetic brush. Here, the toner 25 at the leading edge side of the brush is in sliding contact with the surface of the dielectric belt 2. Further, DC voltage in the range of 100 V to 300 V is applied between the developer electrode 24 and the transparent electrically conductive layer 22 of the photoreceptor drum 1 by a power supply 26, having the developer electrode 24 side as a negative side. By the resulting potential difference, charges having negative and positive polarities respectively adhere to the leading edge portion of the toner 25 and to the transparent electrically conductive layer 22.

Figure 3:
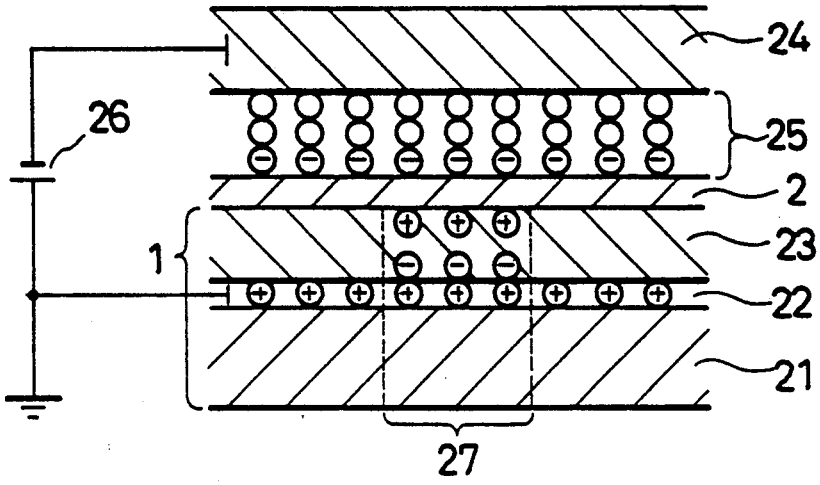

In this state, a light beam is projected according to the image pattern onto the photoconductive layer 23 from the side of the transparent support 21. As a result, a pair of a positive hole and an electron is generated in an illuminated area 27 on the photoconductive layer 23 as shown in FIG. 3. Here, because of the potential difference between the developer electrode 24 and the transparent electrically conductive layer 22, the positive hole moves towards the dielectric belt 2; whereas, the electron moves towards the transparent electrically conductive layer 22 and flows thereinto.

Figure 4:
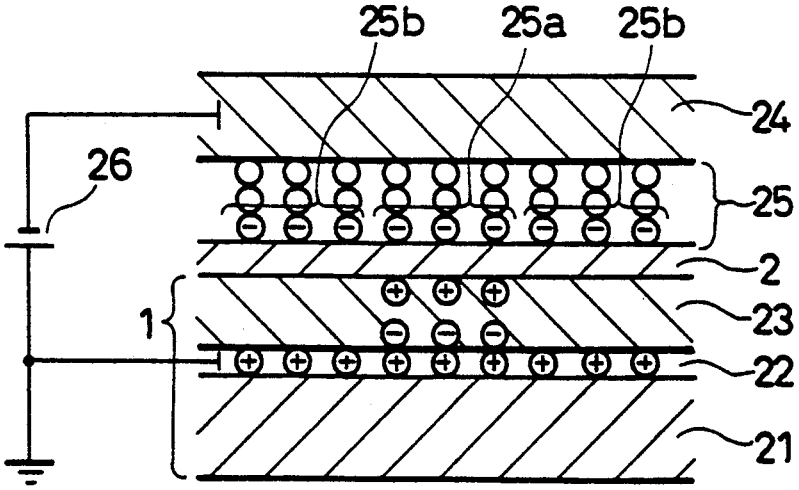

When the projection of a light beam is stopped, the positive hole having moved in the photoconductive layer 23 towards the dielectric belt 2 side is trapped as shown in FIG. 4. Further, an exposure area contact toner 25*a* exists at a position confronting the trapped positive hole with the dielectric belt 2 in between. In the exposure area contact toner 25*a*, a greater number of negative charge are injected and have greater effect from strong Coulomb force than the adjacent non-exposure area contact toner 25*b*.

With the rotation of the photoreceptor drum 1, the developer electrode 24 gradually moves away from the exposure area. Then, the Coulomb force between the exposure area contact toner 25*a* and the positive hole in the photoconductive layer 23 is stronger than the magnetic force from the developer electrode 24 side. As a result, as shown in FIG. 5, the exposure area contact toner 25*a* is separated from the developer electrode 24 side and maintained at the position adhering to the surface of the dielectric belt 2. The exposure area contact toner 25*a* and the trapped positive hole in the photoconductive layer 23 becomes being attracted one another by the injected negative charge, thereby forming a stable toner image. On the other hand, the non-exposure area contact toner 25*b* is attracted towards the developer electrode 24 side by the magnetic force, thereby being separated and moved away from the dielectric belt 2 with the developer electrode 24.

As described, after the toner image is formed on the dielectric belt 2 corresponding to the exposed portion of the image pattern by adhering thereto the exposed area contact toner 25*a*, the toner image on the dielectric belt 2 is transported between the heater 3 and the pressurizing roller 7 shown in FIG. 1. Here, in feeding the copying material 9, the copying material 9 is superposed onto the dielectric belt 2. Therefore, the transfer and fusing processes of toner to the copying material can be carried out simultaneously.

More concretely, while being fed between the heater 3 and pressurizing roller 7, the copying material 9 is heated and pressed by them, and the heater 3 applies heat to the exposure area contact toner 25*a* to be melted. Here, since the dielectric belt 2 is superior to the copying material 9 such as a paper sheet in its high mold release characteristic with respect to the toner 25*a* being melted by a heat treatment. For this reason, almost all the toner 25*a* on the dielectric belt 2 is transferred onto the copying material 9 and made to permanently adhere thereto. This means that cleaning process for removing the residual toner on the dielectric belt 2 is not required with the above arrangement.

In pursuit of more accurately performing the transfer and fusing of the toner thus described, those material having a high mold release characteristic with respect to the melted toner 25*a* such as fluoroplastic is desirably coated on the surface of the dielectric belt 2.

A portion of the dielectric belt 2 whereon the transfer and fusing processes have been completed is fed to the position where the the eraser 10 is located through the tension roller 4. When carrying out the above-mentioned processes, the problem may arise since static electricity is likely to be increased on the surface of the dielectric belt 2 due to a mechanical friction, etc. This may be a problem in forming image in the process of exposure. In order to prevent the occurrence of this problem, the eraser 10 is provided for removing the residual charge. Thereafter, the processes of exposure and development are repeated on the photoreceptor drum 1, thereby successively forming images.

After passing through the area for exposure and development, the positive hole, trapped in the photoconductive layer 23 after the dielectric belt 2 being separated, is gradually released to the surface of the photoreceptor drum 1, and the surface condition thereof goes back to the state in FIG. 2 before carrying out the next processes for exposure and development. Here, as shown in FIG. 1, in pursuit of releasing the trapped positive hole in shorter period by projecting a light beam onto the photoconductive layer 23, a drum photosensitive layer eraser unit 11 for projecting a light beam onto the photoconductive layer 23 of the photoreceptor drum 1 is additionally provided outside the photoreceptor drum 1 within the space surrounded by the dielectric belt 2.

As described, with the arrangement of the present embodiment, an image can be formed without providing the charger 32, transfer unit 35 and cleaner 37 all required in the previously mentioned Carlson process. This permits to trim the size of the apparatus. Moreover, since the corona discharger is not used, the image forming apparatus does not require the high voltage power supply, nor generate ozone.

The photoconductive layer 23 is disposed on the surface of the photoreceptor drum 1. However, the dielectric belt 2 separately provided from the photoreceptor drum 1 is hung on the surface thereof, further, the toner image is formed on the surface of the dielectric belt 2. Therefore, the photoconductive layer 23 formed on the surface of the photoreceptor drum 1 can be prevented from being damaged due to the toner or the cleaner for removing the residual charge in sliding contact therewith. Moreover, since the dielectric belt 2, whereon the toner image is formed, is provided separately from the photoreceptor drum 1, the material to be used for the belt 2 is not restricted by solubility with respect to solvent used in coating the photoconductive layer on the surface of the photoconductor, or the like.

The material excellent in its strength, hard-wearing properties, can be used as long as those can be formed with an adequate resistivity and thickness. By using the stronger material for the dielectric belt 2, the deterioration rate of the dielectric belt 2 as well as the photoreceptor drum 1 can be reduced, thereby providing a longer life of the whole apparatus. Moreover, it is possible to replace only the dielectric belt 2 with new dielectric belt 2 means without replacing the photoreceptor drum 1. This also contributes to provide a longer life of the apparatus.

With this arrangement, the dielectric belt 2 is provided separately from the photoreceptor drum 1, therefore, the toner image formed on the surface of the dielectric belt 2 can be transferred up to a position apart from the photoreceptor drum 1. In this position, the heater 3 and the pressurizing roller 7 can be disposed so as to have the dielectric belt 2 interposed in between. Moreover, since the dielectric belt 2 is separately provided from the photoreceptor drum 1, the material excellent in its heat resistance can be selected for the dielectric belt 2 considering the fusing temperature of the toner. In this way, by pressing the copying material 9 onto the toner being melted on the surface of the dielectric belt 2, the toner image can be transferred from the dielectric belt 2 to the copying material 9 and made to permanently adhere thereto.

As described, the discussed method does not require the transfer unit composed of the corona discharger, etc., that required in the case of conventional Carlson process, thereby permitting to trim the size of the apparatus. Moreover, with this method, the transfer and fusing processes are carried out simultaneously. Therefore, compared with the conventional case where the toner image is transported to the fuser after being transferred to the copying material, to be permanently affixed thereto, the turbulence of the toner image is controlled, and the better quality of the toner image is attained. Moreover, since the transfer and fusing processes of the toner image can be carried out simultaneously, the shorter transport distance of the copying material 9 is required, and thus time required for forming image is also reduced, thereby reducing the occurrence of the copying material being jammed in the apparatus.

Moreover, with the conventional method wherein paper sheet is used as a copying material, and the transfer of the toner image is carried out by pressing the corona charger or the voltage application roller onto the back surface of the paper sheet, in the case of using electrically conductive toner, a special sheet is required with an insulating film formed thereon since it is difficult to transfer onto the normal sheet with relatively low resistivity. Whereas, with the arrangement of the present embodiment, the transfer is preformed not by the electric Coulomb force but by the adhesiveness of the toner. This permits to perform the transfer and fixing operations with respect to the normal sheet even when the electrically conductive toner is used.

With this arrangement, by providing the exposure unit 5 within the photoreceptor drum 1, a space for providing the exposure means 5 is not separately required. This permits to still trim the size of the apparatus. Moreover, since the exposure unit 5 is covered by the photoreceptor drum 1, dust adhering to the exposure unit 5 can be reduced. In this way, a constant amount of light beams projected from the exposure unit 5 can be maintained for a long time, whereby a desirable image quality can be also maintained.

As shown in FIG. 1, the pair of eraser 10 for removing the residual charge on the dielectric belt 2, is disposed between the photoreceptor drum 1 and the tension roller 4, and the blushes thereof are in sliding contact with the dielectric belt 2 being interposed by the blushes. With this arrangement, the residual charge can be quickly and accurately removed. This also enables the clear image to be formed without having a turbulence in the toner image due to the residual charge after the exposure. Moreover, the image forming speed of the dielectric belt 2 is also improved by, for example, increasing the travelling speed of the dielectric belt 2.

Here, the above preferred embodiment is included merely to aid in the understanding of the invention, and variations may be made by one skilled in the art without departing from the spirit and scope of the invention. For example, the dielectric magnetic toner 25 is used in the above embodiment; however, other types of toner than those used in the electrophotographic printing method is used as well for the development.

Similarly, although the dielectric belt 2 made of a polyimide film has been used in the above embodiment.

Other material may be used as long as those can be formed in a belt shape with no end with an appropriate mechanical strength. The material other than the polyimide film, film material including mainly a polyamide is preferably used.

As described, the electrophotographic printing machine in accordance with the present invention is arranged so as to include photoreceptor means including a cylindrical base having an electrically conductive layer and a photoconductive layer laminated in this order on a periphery surface thereof; moving means wound around a surface of the photoreceptor means and firmly adhering thereto for integrally moving therewith; electrically conductive toner hold means for applying an electrically conductive toner on the surface of the moving means, the support means being provided in a vicinity of the surface of the dielectric belt in a contact area between the moving means and the photoreceptor means; voltage application means for applying voltage across the toner hold means and the electrically conductive layer; and exposure means for exposing the photoconductive layer in the contact area, wherein the exposure means exposes the photoconductive layer in the contact area while applying voltage across the support means and the electrically conductive layer, thereby forming a toner image on the surface of the moving means. The cylindrical base in this embodiment of the invention is preferably made of an aluminum ceramic.

With this arrangement, the photoconductive layer formed on the surface of the photoreceptor means can be prevented from being damaged due to the toner or the cleaner for removing the residual charge in sliding contact therewith. Moreover, since the moving means, whereon the toner image is formed, is provided separately from the photoreceptor means, unlike the conventional case, the material to be used for the moving means is not restricted by solubility with respect to solvent used in coating the photoconductive layer on the surface of the photoconductor means, or the like. The material excellent in its strength, hard-wearing properties, can be used as long as those can be formed with an adequate resistivity and thickness. By using the stronger material for the moving means, the deterioration rate of the moving means as well as the photoreceptor means can be reduced, thereby providing a longer life of the whole apparatus. Moreover, it is possible to replace only the moving means with new moving means without replacing the photoreceptor means. This also contributes to provide a longer life of the apparatus.

Moreover, the electrophotographic printing machine having the above configuration in accordance with the present invention may be arranged to further comprise: heating means for melting by a heat treatment the toner of the toner image formed on the surface of the moving means after the photoreceptor means passes an exposure area; and the pressure means for pressing a superposed portion between the copying material and the moving means toward the heating means, the pressure means being disposed confronting the heating means so as to have the moving means and the copying material being transported thereon interposed in between.

As described, the discussed method does not require the transfer unit composed of the corona discharger, etc., that required in the case of conventional Carlson process, thereby permitting to trim the size of the apparatus. Moreover, with this method, the transfer and fusing processes are carried out simultaneously. Therefore, compared with the conventional case where the toner image is transported to the fuser after being transferred to the copying material to be permanently affixed thereto, the turbulence of the toner image is controlled, and the better quality of the toner image is attained.

Further, the electrophotographic printing machine in accordance with the present invention may also be arranged such that the cylindrical base and the electrically conductive layer of the photoreceptor means are made of a transparent material, the exposure means is disposed in the photoreceptor means wherein a light beam is projected onto the photoconductive layer through the cylindrical base and the electrically conductive layer, thereby exposing the photoconductive layer.

With this arrangement, a space for providing the exposure means is not separately required. This permits to trim the size of the whole apparatus. Moreover, since the exposure means is covered by the photoreceptor means, dust adhering to the exposure means can be reduced. In this way, a constant amount of light beams projected from the exposure means can be maintained for a long time, whereby a desirable image quality can be maintained.

While this invention has been disclosed in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. An electrophotographic printing machine comprising:

photoreceptor means including a cylindrical base having an electrically conductive layer and a photoconductive layer laminated in this order on a periphery surface thereof;

dielectric moving means wound around a surface of said photoreceptor means and firmly adhering thereto for integrally moving therewith;

electrically conductive toner hold means for applying an electrically conductive toner on a surface of said moving means, said electrically conductive toner hold means being provided in a vicinity of the surface of said moving means in a contact area between said moving means and said photoreceptor means;

voltage application means for applying voltage across said toner hold means and the electrically conductive layer; and exposure means for exposing the photoconductive layer in the contact area to form a latent image on the surface of the photoconductive layer with no discharging of the photoconductive layer occurring during exposure, wherein said exposure means exposes the photoconductive layer in the contact area while applying voltage across said toner hold means and the electrically conductive layer so as to polarize the photoconductive layer, thereby forming a toner image on the surface of said moving means, thereby providing an image without a charge device for charging the photoconductive layer of said photoreceptor means.

2. The electrophotographic printing machine as set forth in claim 1 further comprising:

heating means for melting by a heat treatment the toner of the toner image formed on the surface of the moving means after the moving means passes an exposure area; and pressure means for pressing a superposed portion between the copying material and the moving means toward said heating means, the pressure means being disposed confronting said heating means so as to have said moving means and the copying material being transported thereon interposed in between.

3. The electrophotographic printing machine as set forth in claim 2, wherein said pressure means includes a pressurizing roller rotating while applying pressing force towards said heating means.

4. The electrophotographic printing machine as set forth in claim 2, wherein said heating means comprises a heater including a base having a resistance heater and a glass coat laminated thereon in this order by printing.

5. The electrophotographic printing machine as set forth in claim 4, wherein the base is made of an alumina ceramic; and said electrical resistance heater is a Mo series electrical resistance heater.

6. The electrophotographic printing machine as set forth in claim 2, wherein said moving means is designed to be belt-shaped with no end.

7. The electrophotographic printing machine as set forth in claim 6, further comprising:

tension roller being rotatively provided, wherein said moving means belts said tension roller, said photoreceptor means and said heating means so as to surround them from outside and receives appropriate strength of tensile force from said tension roller so as to be in tight contact with said photoreceptor means.

8. The electrophotographic printing machine as set forth in claim 2, wherein said moving means is made of a material excellent in its mechanical strength, wear resistance and heat resistance.

9. The electrophotographic printing machine as set forth in claim 8, wherein said moving means is made of a film material including polyimide.

10. The electrophotographic printing machine as set forth in claim 9, wherein said moving means is arranged to be belt-shaped with a thickness of substantially 20 μm.

11. The electrophotographic printing machine as set forth in claim 8, wherein said moving means is made of a film material including polyamide.

12. The electrophotographic printing machine as set forth in claim 2 wherein a film made of a dielectric material and a high mold release characteristic with respect to a molten toner is coated on a surface of said moving means.

13. The electrophotographic printing machine as set forth in claim 12, wherein a film made of a fluoroplastic is coated on a surface of said moving means.

14. The electrophotographic printing machine as set forth in claim 1, wherein the cylindrical base and the electrically conductive layer are made of a transparent material.

15. The electrophotographic printing machine as set forth in claim 14, wherein the cylindrical base is made of a transparent glass.

16. The electrophotographic printing machine as set forth in claim 14, wherein the electrically conductive layer is constituted of a thin film made of $SnO_2$.

17. The electrophotographic printing machine as set forth in claim 1, wherein said exposure means is disposed in the cylindrical base of said photoreceptor means, and an exposure of the photoconductive layer is carried out by projecting thereon a light beam through the cylindrical base and the electrically conductive layer.

18. The electrophotographic printing machine as set forth in claim 17, wherein said exposure means includes a light emitting diode (LED) array that is a combination of the LED and the lens having a short focal distance.

19. The electrophotographic printing machine as set forth in claim 1 further comprising:

eraser means for electrostatically eliminating the charge on said moving means, said eraser means being disposed along a travel area of the moving means up to the contact area between the moving means and the photoreceptor means.

20. The electrophotographic printing machine as set forth in claim 19, wherein:

said eraser means includes an electrically conductive contacting component in sliding contact with said moving means, said contacting component being connected to ground.

21. The electrophotographic printing machine as set forth in claim 20, wherein a plurality of said contacting component exists, said contacting component being in contact with both sides of belt-shaped moving means.

22. The electrophotographic printing machine as set forth in claim 20, wherein said contacting component is a brush-shaped electrically conductive brush, a leading edge thereof being in sliding contact with said moving means.

23. The electrophotographic printing machine as set forth in claim 22, said electrically conductive brush is made of carbon conjugated fiber.

24. The electrophotographic printing machine as set forth in claim 1, further comprising:

photoconductive layer eraser means for erasing an electrostatic latent image by projecting a light beam on the photosensitive layer after the toner image is formed on the surface of said moving means.

25. The electrophotographic printing machine as set forth in claim 1, wherein said voltage application means is arranged so as to output DC voltage in a range of 100 V to 300 V.

26. The electrophotographic printing machine as set forth in claim 1, wherein the toner has electrically conductive and magnetic properties, and said toner hold means includes magnetic field generation means for supporting the toner having electrically conductive and magnetic properties by magnetic force.

27. The electrophotographic printing machine as set forth in claim 26, wherein said magnetic field generation means is a permanent magnet.

28. The electrophotographic printing machine as set forth in claim 26, wherein said magnetic field generation means is an electromagnet.

29. The electrophotographic printing machine as set forth in claim 1, wherein said photoconductive layer is made of amorphous silicone with a thickness of substantially 20 μm.

30. The electrophotographic printing machine as set forth in claim 1, wherein said moving means is in tight contact with substantially a semi-circumference of said photoreceptor means.

31. An electrophotographic printing machine comprising:

a photoreceptor drum including a transparent cylindrical base having an electrically conductive layer and a photoconductive layer laminated in this order on a periphery surface thereof;

a dielectric belt with no end, said belt would around a surface of said photoreceptor drum and firmly adherent thereto for integrally moving therewith;

an electrically conductive toner hold means for applying an electrically conductive toner on the surface of said dielectric belt, said toner hold means being provided in a vicinity of the surface of said dielectric belt in a contact area between said dielectric belt and said photoreceptor drum;

a power supply for applying voltage across said toner hold means and the electrically conductive layer;

an exposure unit for exposing the photoconductive layer in the contact area to form a latent image on the surface of the photoconductive layer, with no discharging of the photoconductive layer occurring during exposure, by projecting thereon a light beam through the cylindrical base and the electrically conductive layer so as to polarize the photoconductive layer, said exposure unit being disposed in the cylindrical base of said photoreceptor drum;

a heater for melting by a heat treatment the toner of the toner image formed on the surface of the dielectric belt after the photoreceptor drum passes as exposure area;

a pressurizing roller for pressing a superposed portion of the copying material and the dielectric belt toward the heater, the pressurizing roller being disposed confronting said heater so as to have the dielectric belt and the copying material being transported thereon interposed in between; and a tension roller being rotatively provided;

wherein said dielectric belt with no end belts said tension roller, said photoreceptor drum and said heater so as to surround them from outside;

thereby providing an image without a charge device for charging the photoconductive layer of the photoreceptor means.

32. A method for forming an image on a copying material, said method comprising the steps of:

(a) preparing a dielectric belt wound around the surface of a photoreceptor drum including a cylindrical base having an electrically conductive layer and a photoconductive layer laminated in this order on a periphery surface thereof;

(b) forming a toner image on the surface of the dielectric belt by applying a voltage across the dielectric belt and photoconductive layer and exposing the photoreceptor drum to an image without having previously charged the photoconductive layer, thereby polarizing the photoconductive layer and forming a latent image on the surface of the photoconductive layer with no discharging of the photoconductive layer during exposure; and (c) simultaneously carrying out transfer and fusing processes of the toner image formed on the surface of the dielectric belt to a copying material by superposing the copying material onto the toner image by applying thereto heat and pressure.

33. The method for forming image on a copying material as set forth in claim 32 wherein the step (b) includes the steps of:

(d) preparing an electrically conductive toner holder for supplying an electrically conductive toner on the surface of the dielectric belt in a contact area between the dielectric belt and the photoreceptor drum;

(e) making charges on the toner and the electrically conductive layer respectively have polarities opposite from one another by applying voltage across the toner holder and the electrically conductive layer;

(f) forming an electrostatic latent image with charges having opposite polarity from that of the charge on the toner in said step (d) on the dielectric belt side of the photosensitive layer by projecting light on the contact area of the photosensitive layer; and (g) forming toner image corresponding to the electrostatic latent image on the surface of the dielectric belt by setting Coulomb force between the electrostatic latent image and the toner greater than holding power for holding the toner on the toner holder.

* * * * *